United States Patent [19]

Witten et al.

[11] Patent Number: 4,587,892

[45] Date of Patent: May 13, 1986

[54] FOUNDATION VENTILATOR

[75] Inventors: Alvin E. Witten; Erik H. Witten, both of Gastonia, N.C.

[73] Assignee: Witten Automatic Vent Company, Inc., Gastonia, N.C.

[21] Appl. No.: 752,843

[22] Filed: Jul. 8, 1985

[51] Int. Cl.[4] ..... F24F 7/00

[52] U.S. Cl. ..... 98/29; 52/573; 98/114

[58] Field of Search ..... 98/1, 29, 37, 101, 106, 98/107, 108, 114, 118; 52/208, 217, 573

[56] References Cited

U.S. PATENT DOCUMENTS

| | | | |
|---|---|---|---|
| 1,919,393 | 7/1933 | Reinhardt | 52/217 |
| 2,722,170 | 11/1955 | Broberg | 98/114 |
| 3,281,297 | 10/1966 | Schmidt | 52/208 X |
| 3,955,483 | 5/1976 | Sunter | 98/114 |
| 4,515,068 | 5/1985 | Van Becelaere | 98/1 |

FOREIGN PATENT DOCUMENTS

| | | | |
|---|---|---|---|
| 2063156 | 10/1971 | Fed. Rep. of Germany | 52/217 |

*Primary Examiner*—Harold Joyce

*Attorney, Agent, or Firm*—Bell, Seltzer, Park & Gibson

[57] ABSTRACT

The mounting frame of the ventilator is formed of molded plastic so that it contracts when the temperature is low and expands when the temperature is high. In order to accommodate such expansion and contraction, a screw is supported for longitudinal adjustment in one wall of the mounting frame so that the outer end firmly engages one side of the wall opening. A compression spring has its inner end fixed on the opposite wall of the mounting frame and its outer end engages the opposite side of the wall opening. In one disclosed embodiment, the compression spring is tapered with the smaller inner end being fixed to the mounting frame by a screw. In the other embodiment, the compression spring is of the same diameter throughout its length and the inner end is threaded with a threaded bore in the mounting frame.

7 Claims, 7 Drawing Figures

FOUNDATION VENTILATOR

FIELD OF THE INVENTION

This invention relates generally to a foundation ventilator with an improved arrangement for installing and maintaining the ventilator in a rectangular opening in the wall of a building, and more particularly to an improved installing and mounting means provided with resilient means for maintaining the ventilator in position in the wall opening with any expansion or contraction of the ventilator during use.

BACKGROUND OF THE INVENTION

It is a common practice to install ventilators in openings in building walls, such as foundation walls, to provide for the flow of ventilating air through the enclosed crawl space beneath the floor of the building. Normally, the foundation ventilators are installed in the wall openings by applying mortar around the outer edges of the ventilator when it is positioned in the opening.

Commonly owned U.S. Pat. No. 4,274,330 discloses a ventilator mounting frame assembly in which a rectangular frame is first mounted in the opening by means of adjustable fasteners which engage the interior surface adjacent the opening and are adjustable by elongated screws carried by the mounting frame for maintaining the mounting frame in position in the opening. The ventilator is then positioned in and fixed to the mounting frame. The mounting of the ventilator in accordance with this patent requires that the mounting frame and the ventilator be formed in two separate parts and that the mounting frame be initially installed and then the ventilator installed in the mounting frame, which adds to the cost of manufacturing and complicates the installing procedure.

U.S. Pat. No. 3,220,079 discloses a foundation ventilator which is easily and simply mounted in a concrete foundation wall by pushing the same into engagement with resilient flanges on a metal vent box which is positioned in the wall and the concrete is poured around the vent box to provide the wall opening in which the foundation ventilator is supported. However, the foundation ventilator disclosed in this patent is not adapted for mounting in a foundation wall formed of brick and the manufacture and positioning of the vent support box in the foundation adds to the cost of manufacture and installation of the ventilators.

Recently it has been the common practice to form the mounting frame of the foundation ventilator of molded plastic material and to support the ventilator in the wall opening by screws threadably supported in opposite sides of the mounting frame. The mounting frame is positioned in the wall opening and the screws are adjusted outwardly until their outer ends firmly engage the opposite side portions of the wall opening. However, the plastic mounting frame expands when the temperature rises and contracts when the temperature drops so that the screws are not maintained in the proper amount of firm engagement with the wall opening under all temperature conditions. If the ventilator is installed when the temperature is high, the screws tend to loosen when the temperature drops and the mounting frame contracts so that the ventilator may fall out of the wall opening. If the ventilator is installed when the temperature is low, the screws become tighter when the temperature rises and the mounting frame expands so that the mounting frame may be bowed outwardly from the wall opening.

SUMMARY OF THE INVENTION

With the foregoing in mind, it is a object of the present invention to provide a foundation ventilator with improved mounting means providing for the simple installation and maintaining of the ventilator in the wall opening so as to overcome the problems of the prior art.

In accordance with the present invention, the mounting means includes threaded adjustment means at one side of the ventilator for engagement with a corresponding side of the wall opening and resilient means on the opposite side of the ventilator for engaging the opposite side of the wall opening so that the ventilator remains firmly seated in the opening during any expansion or contraction of the ventilator during use.

The ventilator of the present invention includes a molded plastic mounting frame having interconnected horizontal top and bottom walls, and vertical side walls defining a rectangular support frame of predetermined width and height which is of a lesser dimension than the predetermined width and height dimensions of the wall opening so that the support frame may be easily positioned in the wall opening. A peripheral flange extends outwardly from the front portions of the top, bottom and side walls and is adapted to engage the exterior face of the wall surrounding the wall opening to limit inward movement of the support frame into the wall opening and to cover any space between the outer surfaces of the support frame and the interior surfaces of the wall opening. A grill extends across the interior of the top, bottom and side walls and is spaced inwardly of the peripheral flange so that the forward portions of the inner surfaces of the top, bottom and side walls are exposed from the exterior of the ventilator.

Threaded adjustment means is threadably mounted in and extends through the forward exposed portion of a selected one of the top, bottom and side walls and is positioned forwardly of the grill so that the threaded adjustment means may be rotated from a position exteriorly of the ventilator. The threaded adjustment means is illustrated in the form of a screw having an outer end for engaging a corresponding surface of the wall opening and an inner end with a screw slot for manually rotating the screw with a screwdriver from the exterior of the ventilator. The screw is preferably threadably supported in the corresponding wall of the support frame at a slightly inclined angle to provide sufficient clearance for rotation of the screwdriver when adjusting the inward and outward position of the adjustment screw.

In one illustrated embodiment of the present invention, the resilient means mounted on the opposite side of the support frame from the adjustment screw includes a tapered compression spring with an enlarged outer end and a smaller inner end. The smaller inner end is held in contact and in a fixed position on the outer surface of the corresponding wall of the support frame by a screw threaded into the corresponding wall of the support frame.

In another illustrated embodiment of the present ventilator, the resilient means is illustrated in the form of a compression spring of the same diameter throughout its length and having an inner end portion threadably supported in a threaded bore in the corresponding wall of the support frame. The outer end of the compression spring is adapted to engage the corresponding surface of the wall opening to resiliently maintain the ventilator in position in the wall opening.

BRIEF DESCRIPTION OF THE DRAWINGS

Other objects and advantages will appear as the description proceeds when taken in connection with the accompanying drawings, in which—FIG. 1 is a fragmentary isometric view showing the present foundation ventilator installed within a suitable opening in a foundation wall or the like;

DESCRIPTION OF THE ILLUSTRATED EMBODIMENTS

Figure 1:
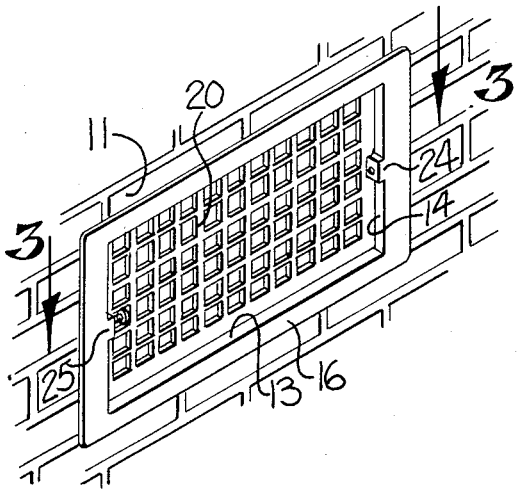
Figure 2:
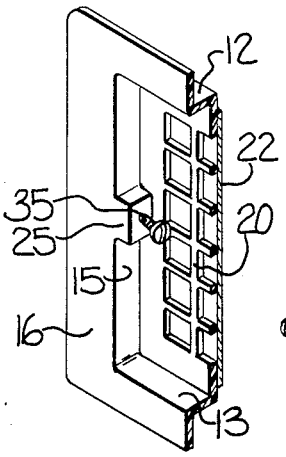
FIG. 2 is an enlarged fragmentary isometric view of one end portion of the ventilator and illustrating the threaded adjustment means mounted therein.
Figure 5:
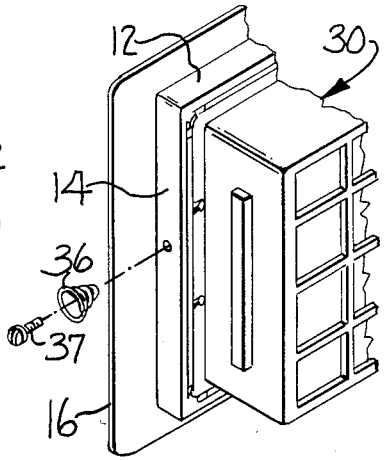
FIG. 5 is a fragmentary exploded isometric view looking at the rear portion of the ventilator and at the opposite end of that shown in FIG. 2.
Figure 3:
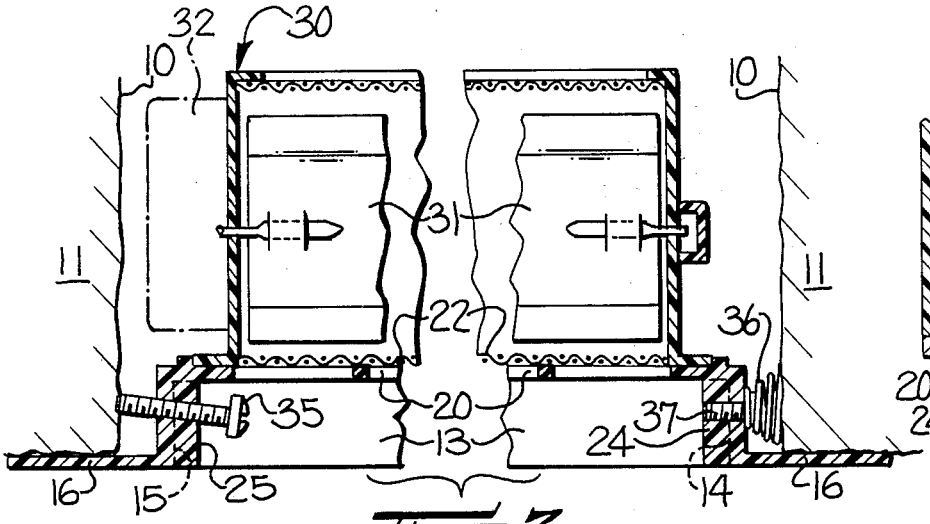
FIG. 3 is a horizontal sectional view taken substantially along the line 3—3 in FIG. 1 with the central portion broken away and illustrating one embodiment of the resilient means mounted on one side of the ventilator.
Figure 4:
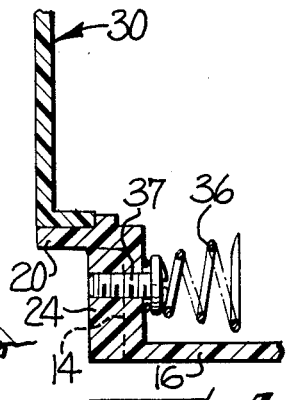
FIG. 4 is an enlarged fragmentary view of the lower right-hand portion of FIG. 3 with the ventilator removed from the opening.

One embodiment of the present foundation ventilator is illustrated in FIGS. 1–5 and installed in a rectangular opening 10 of predetermined width and height in a brick wall 11. The ventilator includes a mounting frame having interconnected corresponding horizontally extending top and bottom walls 12,13 and vertical opposed side walls 14,15 defining a rectangular support frame of predetermined width and height. The predetermined width and height of the support frame is of a slightly lesser dimension than the predetermined width and height dimension of the wall opening 10, as illustrated in FIG. 3, so that the support frame may be easily positioned in the wall opening 10. A peripheral flange 16 extends outwardly from the front portions of the top, bottom and side walls 12–15 and is adapted to engage the exterior face of the wall 11 surrounding the wall opening 10 to limit inward movement of the support frame into the wall opening 10 and to cover any space between the outer surfaces of the support frame and the interior surfaces of the wall opening 10.

The mounting frame, including the walls 12–15 and the peripheral flange 16, is preferably molded of suitable plastic material in a single-piece construction and a grill 20 is integrally molded with the inner portions of the walls 12–15 and is spaced inwardly of the flange 16 so that the forward portions of the walls 12–15 are exposed from the exterior of the ventilator. A suitable screen 22 may be fixed to the inner surface of the grill 20. In order to provide additional thickness to the medial portions of the opposite side walls 14,15 corresponding boss members 24,25 are integrally molded with and extend inwardly from the corresponding side walls 14,15 for purposes to be presently described.

The inner portion of the mounting frame may be provided with a housing, broadly indicated at 30, for supporting a well-known type of temperature responsive shutters, indicated at 31. The temperature responsive shutters 31 may be of the type shown and described in commonly-owned Witten U.S. Pat. No. 3,528,606. The shutters 31 are automatically opened in the summer and closed in the winter by temperature control means in a control box indicated in dash-dot lines at 32 in FIG. 3. The inner portion of the temperature responsive shutter supporting housing 30 may be suitably secured to the inner portion of the mounting frame in any suitable manner.

In accordance with the present invention, the mounting means includes threaded adjustment means threadably mounted on and extending through the forward exposed portion of a selected one of the top, bottom and side walls 12–15 and forwardly of the grill 20. In FIGS. 1–5, the threaded adjustment means is illustrated in the form of a screw 35 threadably embedded in an opening extending through the boss 25 and the side wall 15 and having an inner end for engaging a corresponding surface of the wall opening 10. The outer end of the screw 35 is provided with a head and a screwdriver slot for manually rotating the screw 35 from the exterior of the ventilator. As illustrated in FIG. 3, the screw 35 is preferably supported in the boss 25 and the side wall 15 at a slightly inclined outward angle so that the screwdriver can be engaged with the head of the screw and will be at an outwardly inclined angle when rotating the same to provide sufficient clearance for the hand and to prevent engaging of the knuckles of the user with the grill 20 when rotating the screw 35 to adjust the same inwardly and outwardly, as required.

In the embodiment of FIGS. 1–5, resilient means is mounted on a wall of the support frame opposite the adjustment screw 35 and is illustrated as being mounted on the side wall 14. The resilient means illustrated in FIGS. 1–5 includes a tapered compression spring 36 having an enlarged outer end and a reduced inner end. The reduced inner end of the tapered compression spring 36 is held in engagement with the outer surface of the side wall 14 by the head of a screw 37 which is threadably supported in the side wall 14 and the boss 24. It is to be understood that the compression spring 36 need not be tapered throughout its entire length but may be of uniform diameter and provided with an inner coil of reduced diameter to be engaged and held in position by the screw 37.

The present foundation ventilator may be quickly and simple installed and maintained in the rectangular opening 10 of the wall 11 by positioning the ventilator in the opening 10 and rotating the screw 35 to move it inwardly until the compression spring 35 on the opposite side thereof is compressed, as illustrated in FIG. 3. When mounted in this manner, the ventilator will remain in the opening regardless of any expansion or contraction of the plastic ventilator mounting frame during temperature changes in the surrounding atmosphere from one season to the other. For example, it has been found that the plastic mounting frame will expand and contract as much as one-eighth of an inch between the extreme temperatures prevailing during winter months and the high temperatures experienced during the hot summer months. Thus, any contraction or expansion of the plastic mounting frame will be accommodated by the compression spring 36 so that the ventilator remains firmly in position regardless of the amount of contraction and expansion of the plastic mounting frame. Also, the foundation ventilator may be easily removed, if required, by applying a sidewise force against the side wall 14 to compress the compression 36 a sufficient amount that the inner end of the adjustment screw 35 will move out of engagement with the opening 10 in the wall and permit easy removal of the ventilator.

Figure 6:
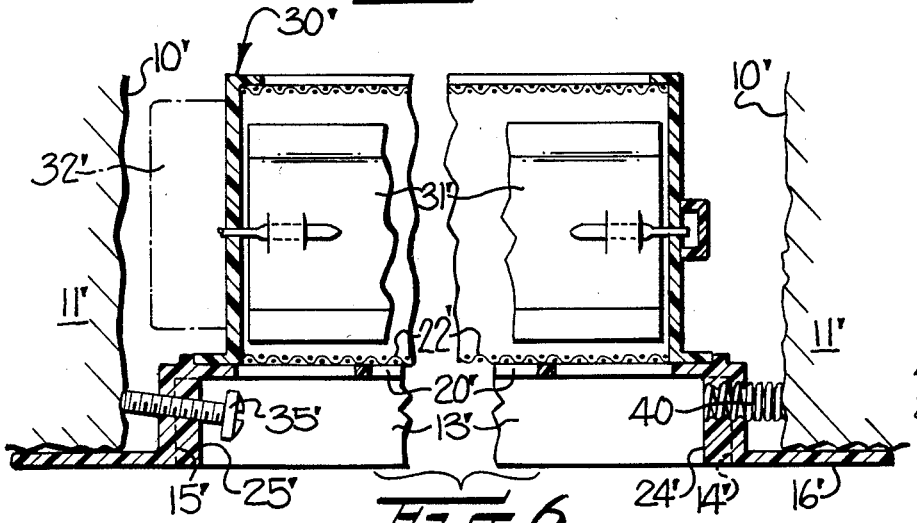
FIG. 6 is a view similar to FIG. 3 but illustrating a different embodiment of resilient means for supporting the ventilator.
Figure 7:
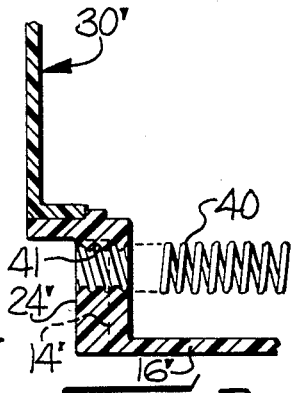
FIG. 7 is an enlarged fragmentary view of the lower right-hand portion of FIG. 6 with the ventilator removed from the opening.

The embodiment of the present invention illustrated in FIGS. 6 and 7 is very similar in many respects to the embodiment of the ventilator illustrated in FIGS. 1–6 and like reference characters will apply to corresponding parts of this embodiment of the invention, with the prime notation added. In this embodiment of the invention, the threaded adjustment means is also illustrated as a threaded screw 35' which is identical to the adjustment screw 35 of the first embodiment of the invention. The resilient means on the opposite side of the mounting frame is illustrated in this embodiment as including a compression spring 40 of the same diameter from the inner to the outer ends thereof. The inner end portion of the compression spring 40 is mounted in the side wall 14' and boss 24' by means of a threaded bore 41 (FIG. 7) extending therethrough. The coils of the inner portion of the compression spring 40 are threaded into the threaded bore 41 and supported thereby.

To install the ventilator of FIGS. 6 and 7, the mounting frame is positioned in the opening 10' with the outer end of the compression spring 40 in engagement with the corresponding side of the opening 10' and the adjustment screw 35' is rotated to engage the opposite wall of the opening 10' and apply compression to the spring 40. After the ventilator is installed, any contraction and expansion of the width of the plastic mounting frame is compensated for by the compression spring 40 resiliently maintaining the ventilator outer end of the screw '35 in firm engagement with the opening 10' of the wall 11'.

Thus, the ventilator of the present invention includes mounting means for installing and maintaining the same in a rectangular opening of a predetermined width and height in a wall. The mounting of the ventilator may be quickly and simply carried out from the exterior side of the wall. The mounting means includes threaded adjustment means on one side of the mounting frame and resilient means on the opposite side for accommodating any expansion or contraction of the plastic mounting frame while the ventilator is installed.

In the drawings and specification there has been set forth the best mode presently contemplated for the practice of the present invention and although specific terms are employed, there are used in a generic and descriptive sense only and not for purposes of limitation the scope of the invention being defined in the claims.

That which is claimed is:

1. A foundation ventilator including quick and simple means for installing and maintaining the same in a rectangular opening of predetermined width and height in a wall from the exterior side of the wall, said ventilator comprising a molded plastic mounting frame including interconnected horizontal top and bottom walls and vertical side walls defining a rectangular support frame of predetermined width and height of a lesser dimension than said predetermined width and height dimension of said wall opening, a peripheral flange extending outwardly from the front portions of said top, bottom and side walls and adapted to engage the exterior face of the wall surrounding said wall opening to limit inward movement of said support frame into said wall opening and to cover any space between the outer surfaces of said support frame and the interior surface of said wall opening, a grill extending across the interior of said top, bottom and side walls and being spaced inwardly of said flange so that the forward portions of the inner surfaces of said top, bottom and side walls are exposed from the exterior of said ventilator, threaded adjustment means threadably mounted in and extending through the forward exposed portion of a selected one of said top, bottom and side walls and forwardly of said grill, said threaded adjustment means including an outer end for engaging a corresponding surface of said wall opening and an inner end with means for manually rotating the same from the exterior of said ventilator, and resilient means mounted on a selected one of said top, bottom and side walls opposite said one wall in which said threaded adjustment means is mounted, said resilient means extending outwardly from said opposite wall and including an outer end for engaging a corresponding surface of said wall opening, said resilient means maintaining said outer end of said threaded adjustment means in resilient contact with the opposite surface of said wall opening with any expansion or contraction of the ventilator dimensions during use.

2. A foundation ventilator according to claim 1 wherein said threaded adjustment means is threadably mounted in one of said side walls, and wherein said resilient means is mounted on the opposite side wall.

3. A foundation ventilator according to claim 1 wherein said threaded adjustment means comprises a screw threadably mounted in one of said side walls and having its head positioned in front of said grill.

4. A foundation ventilator according to claim 3 wherein said screw is mounted in an outwardly inclined angle in said one side wall.

5. A foundation ventilator according to claim 3 wherein said resilient means comprises a compression spring having an inner end mounted on the side wall opposite said one side wall.

6. A foundation ventilator according to claim 5 wherein said compression spring is tapered with a small inner end and a large outer end, and including a screw maintaining said small inner end of said tapered compression spring against said opposite side wall.

7. A foundation ventilator according to claim 5 wherein said compression spring is of the same diameter throughout its length, said opposite side wall including a threaded bore therein, and wherein the inner end of said compression spring is threadably supported in said threaded bore.

* * * * *